US009000670B2

(12) United States Patent
Whyman

(10) Patent No.: US 9,000,670 B2
(45) Date of Patent: Apr. 7, 2015

(54) HARMONIC MODE MAGNETRON

(71) Applicant: L-3 Communications Corporation, San Carlos, CA (US)

(72) Inventor: Neil G. Whyman, Williamsport, PA (US)

(73) Assignee: L-3 Communications Corporation, San Carlos, CA (US)

( * ) Notice: Subject to any disclaimer, the term of this patent is extended or adjusted under 35 U.S.C. 154(b) by 158 days.

(21) Appl. No.: 13/785,530

(22) Filed: Mar. 5, 2013

(65) Prior Publication Data

US 2013/0241407 A1 Sep. 19, 2013

Related U.S. Application Data

(60) Provisional application No. 61/609,154, filed on Mar. 9, 2012.

(51) Int. Cl.
*H01J 25/50* (2006.01)
*H01J 23/24* (2006.01)
*H01J 25/52* (2006.01)

(52) U.S. Cl.
CPC *H01J 23/24* (2013.01); *H01J 25/52* (2013.01)

(58) Field of Classification Search
CPC ..... H01J 23/24
USPC ..... 315/39.75, 39.51
See application file for complete search history.

(56) References Cited

U.S. PATENT DOCUMENTS

| | | | | | |
|---|---|---|---|---|---|
| 2,948,828 | A * | 8/1960 | Ashkin | 315/3.6 |
| 3,271,614 | A * | 9/1966 | Scott | 315/3.5 |
| 3,346,766 | A * | 10/1967 | Feinstein | 315/39.71 |
| 3,508,108 | A * | 4/1970 | Salisbury | 315/3.5 |
| 3,593,220 | A * | 7/1971 | Rooney | 333/211 |
| 4,223,246 | A * | 9/1980 | Osepchuk | 315/39.71 |
| 4,270,069 | A * | 5/1981 | Wiehler | 315/3.5 |
| 4,567,401 | A * | 1/1986 | Barnett et al. | 315/5 |
| 4,572,985 | A * | 2/1986 | Kuntzmann et al. | 315/3.5 |
| 5,083,060 | A * | 1/1992 | Nugues et al. | 315/3.5 |
| 5,084,651 | A * | 1/1992 | Farney | 315/39.51 |
| 5,280,218 | A * | 1/1994 | Smith | 315/39.3 |
| 5,552,672 | A * | 9/1996 | Rosenberg | 315/39.51 |
| 5,742,209 | A * | 4/1998 | Lemke et al. | 331/82 |
| 7,245,082 | B1 * | 7/2007 | Fleming | 315/39.67 |
| 7,279,842 | B2 * | 10/2007 | Mulcahy et al. | 315/39.69 |

* cited by examiner

*Primary Examiner* — Douglas W Owens
*Assistant Examiner* — Srinivas Sathiraju
(74) *Attorney, Agent, or Firm* — O'Melveny & Myers LLP

(57) ABSTRACT

A novel magnetron achieves increased power output at high frequencies by replacing a typical resonant cavity with a slow-wave waveguide structure. Waveguides built into the anode body sustain oscillations having phase change coefficients of 2*pi*n radians per section, where n is a positive integer. The magnetron is capable of supporting RF oscillations at frequency harmonics of the fundamental frequency, permitting it to operate at frequencies double or quadruple that of a similarly sized conventional magnetron.

12 Claims, 7 Drawing Sheets

HARMONIC MODE MAGNETRON

RELATED APPLICATIONS DATA

This application claims priority pursuant to 35 U.S.C. §119 (e) to U.S. Provisional Patent Application Ser. No. 61/609,154, filed Mar. 9, 2012, the subject matter of which is incorporated by reference herein in its entirety.

BACKGROUND OF THE INVENTION

1. Field of the Invention

The present invention relates to magnetrons, and more particularly, to specially designed anodes that enable higher frequencies to be generated by using frequency harmonics.

2. Description of Related Art

Magnetrons are known in the art and operate to convert DC electrical current to Radio Frequency (RF) power. FIG. 1 illustrates the basic operation of a class of magnetron known in the art as a slot-and-hole anode type magnetron. A heated cathode 102 acts as a source of electrons. The cathode passes through a central cylindrical cavity 106 passing through the anode 112. The anode 112 is formed from a conductive metal such as copper. A DC electric field is created by applying a DC voltage (not shown) between the anode 112 and the cathode 102; in the absence of a magnetic field this would cause electrons to travel in the radial direction 104 from the negatively charged cathode toward the anode. In the slot-and-hole type anode depicted, an even number of resonant cavities are formed by a rectangular opening ("slot") 116 connected to a circular opening ("hole") 114 with each slot forming a connection between the central cylindrical cavity 106 and the hole. A magnetic field 122 is applied in a direction perpendicular to the electric field (pointing out of the page in the figure). The magnetic field acts on the radially accelerating electrons causing the electron's movement path to curve. As the electrons pass through the magnetic field, electrons passing by a slot opening give up some energy, and the resonant cavities begin to oscillate at a natural resonant frequency determined by the geometry of the cavities. The metal walls of each resonant cavity facing the central cavity 120 ("vanes"), interact with the passing electrons and build up localized charge distributions that change with the resonant cavity oscillations.

FIG. 2 shows an instantaneous view of the RF electric field of a magnetron operating in the π mode. The term π mode refers to the phase difference in radians of the RF electric field between adjacent vanes in the magnetron anode. Arrowed lines 202 show the direction of the RF electric field vectors at a particular half cycle maximum of the magnetron operation. Two shorting rings 207 connect to alternating vanes at contact points 209, the inner ring connects to "even" vanes while the outer ring connects to "odd" vanes. The alternating circumferential field maximums 204 interact with the electrons curling through the magnetic field, and allow a sustained oscillation at the operating frequency of the device.

Because the operating frequency of magnetron operation depends on the dimensions of the anode and resonant cavities, magnetrons typical of the prior art operating at higher frequencies decrease in size as operating frequencies increase. The smaller vanes associated with smaller cavities are unable to remove heat as quickly. Smaller central cavities also require a greater magnetic field strength to properly divert the electrons emitted from the cathode over a shorter traveling distance between anode and cathode. Since output power also depends on the DC electric field established between the cathode and anode, the corresponding reduced central cavity dimensions increase the likelihood of breakdown voltage gradients. Additionally, cathode loading becomes a limiting factor as frequency increases. Due to these limitations, a larger magnetron anode capable of operating at higher frequencies is desirable.

SUMMARY OF THE INVENTION

An embodiment of the present invention achieves a magnetron with greater power output at high frequencies by replacing a typical resonant cavity with a slow-wave waveguide structure. In one embodiment, a harmonic mode magnetron for converting DC electrical current to RF power includes an anode body formed from a conductive material such as copper and including a central cavity. A cathode is fixed within the central cavity of the anode body. The anode body includes at least two slow-wave waveguide structures each having a channel with a rectangular cross section cutting through the anode body in a continuous path. Each slow-wave waveguide structure has two openings into the central cavity such that the two openings and the channel define a central column of anode body material between them. The central column forms one broadwall of the slow-wave waveguide structure and another broadwall of the slow-wave waveguide structure is formed from the anode body material. Each of the slow-wave waveguide structures also includes one narrow wall formed by the anode body. The other narrow wall may be formed from a cap material joined to the anode body or may be formed from the anode body itself.

In some embodiments, the harmonic mode magnetron may include mode-isolating structures for suppressing certain harmonic oscillation modes. For example, the mode-isolating structures may comprise irises formed within the slow-wave waveguide structures. These irises may be transmitting or non-transmitting irises. In other embodiments, the mode-isolating structures may be discrete high-Q cavities coupled to each slow-wave waveguide structure. In other embodiments, the mode-isolating structure may be a coaxial cavity coupled to all of the slow-wave waveguide structures.

In some embodiments of a harmonic mode magnetron, the anode may include an odd number of slow-wave waveguide structures. Because the harmonic mode magnetron is designed to operate in a $2\pi*n$ resonant mode, an odd number of resonators is advantageous in that the π mode is effortlessly suppressed.

DETAILED DESCRIPTION OF THE PREFERRED EMBODIMENT

An embodiment of the present invention includes a method and apparatus for operating a magnetron with greater power output at high frequencies by replacing a typical resonant cavity with a slow-wave waveguide structure.

Figure 1:
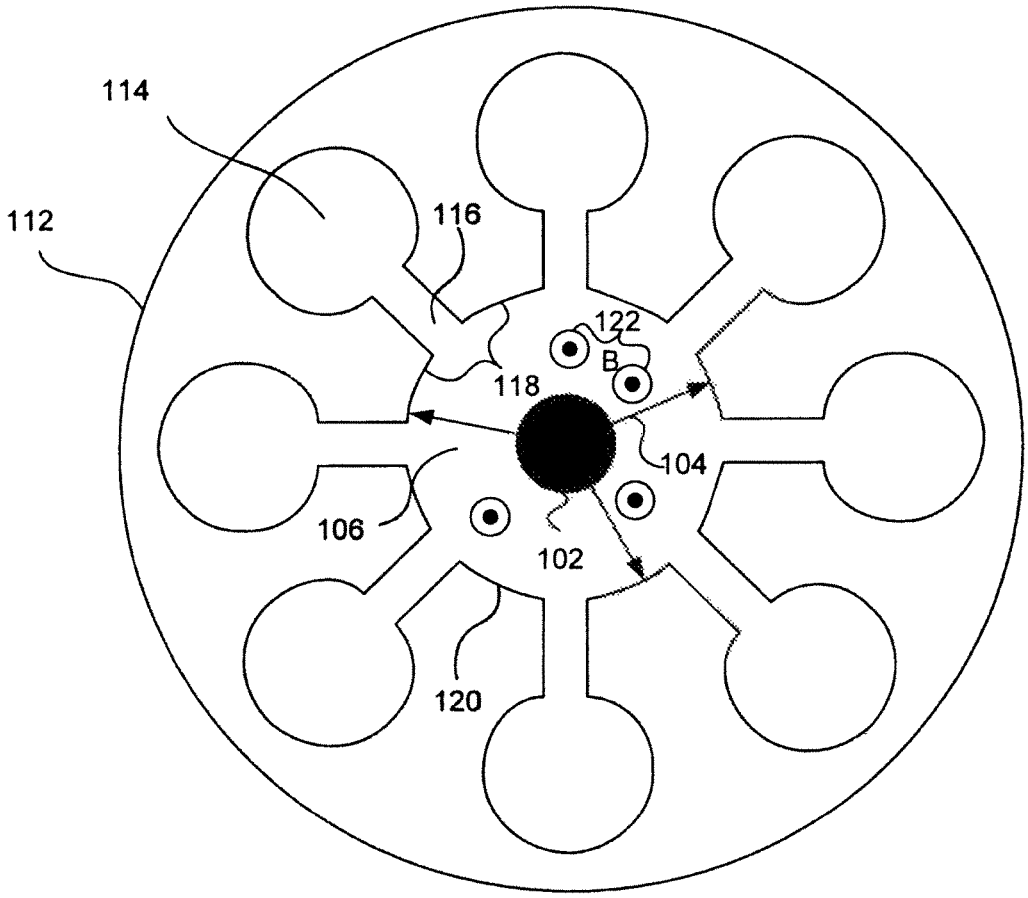
Figure 1 Prior Art
FIG. 1 depicts a slot-and-hole magnetron structure typical of the prior art.
Figure 2:
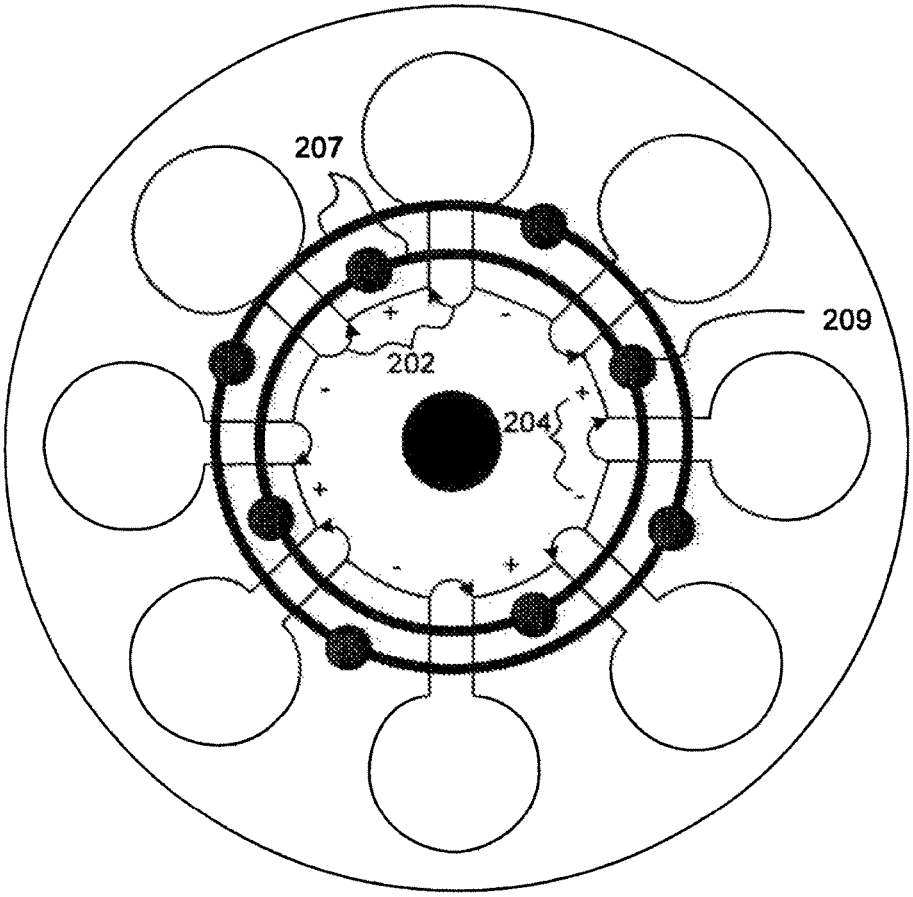
Figure 2 Prior Art
FIG. 2 depicts a magnetron typical of the prior art operating in the π mode.
Figure 3A:
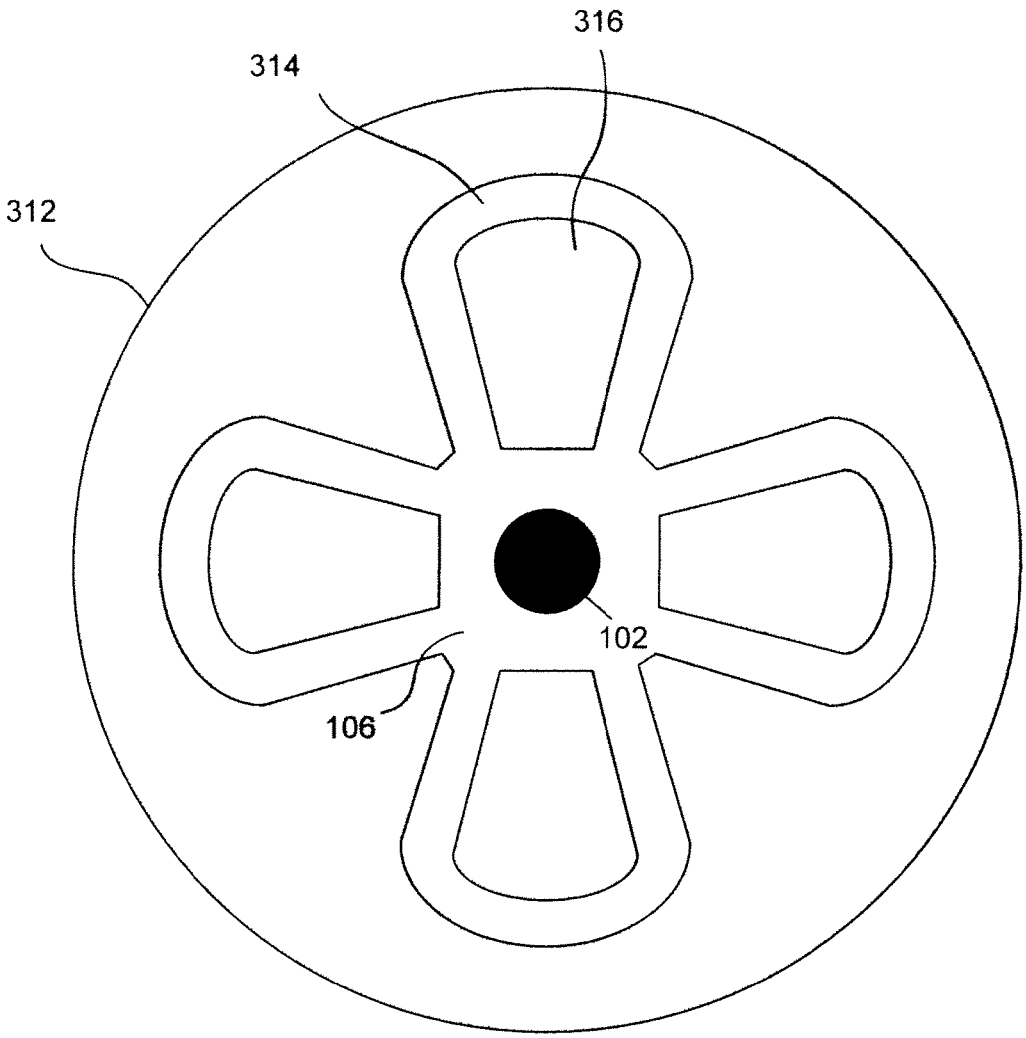
FIG. 3A depicts a top view of a slow-wave waveguide harmonic mode magnetron structure.
Figure 3B:
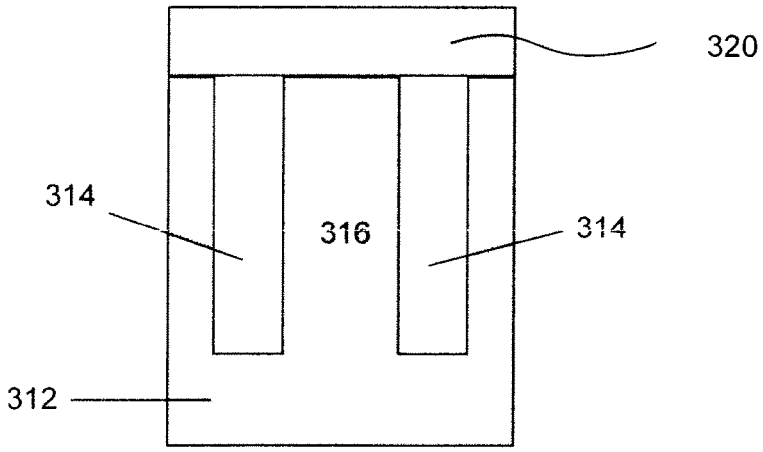
FIG. 3B depicts a cross sectional view through the slow-wave waveguide harmonic mode magnetron structure depicted in FIG. 3A.

FIGS. 3A and 3B illustrates two views of one embodiment of a harmonic mode magnetron in accordance with the present invention. The magnetron anode 312 has a central cavity 106, with cathode element 102 passing through the center. Rather than having resonant cavities forming the anode, the anode comprises a number of slow-wave waveguide structures. A portion of the anode material, 316, remains forming one of the broadwalls of a waveguide where the channel 314 forms the waveguide structure.

FIG. 3B shows the cross-section of one of the waveguide structures. In this embodiment the waveguide cavity is constructed within one solid piece of the anode 312. The central column 316 forms one broadwall of the waveguide, while the rest of the anode bulk 312 forms the other broadwall of the waveguide. In addition, one narrow wall of the waveguide is formed by the end of the waveguide channel 314 along the anode bulk 312. In this embodiment, an additional piece of cap material 320 forms the second narrow wall when joined with the rest of the anode 312. Heat caused by interaction of electrons and the waveguide openings is conducted along the bulk material forming the broad walls and the central columns toward the anode bulk and cap areas where it can be dissipated. The large amount of conducting material near the interaction area allows for significant heat dissipation. This heat dissipation is important because heat is a limiting factor for magnetron power output.

Although the anode construction is described in terms of a bulk piece of material and a cap piece of material, one skilled in the art will recognize that other anode fabrication techniques, which form wave guides acting as the resonating element in a magnetron, are within the scope and spirit of the present invention. For example, a similar anode could be constructing using a mold and casting technique and thus being constructing from one solid piece of metal.

Figure 4:
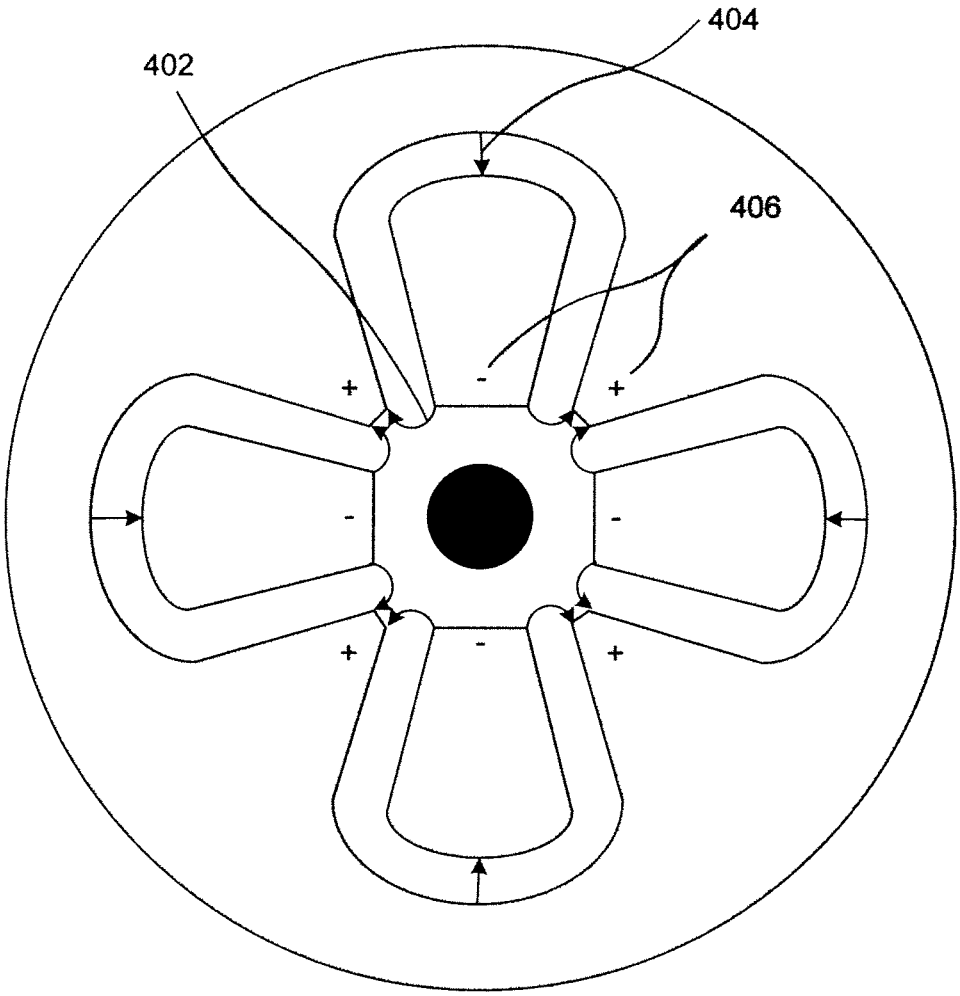
FIG. 4 depicts a slow-wave waveguide harmonic mode magnetron structure operating in the 2π mode.
Figure 5:
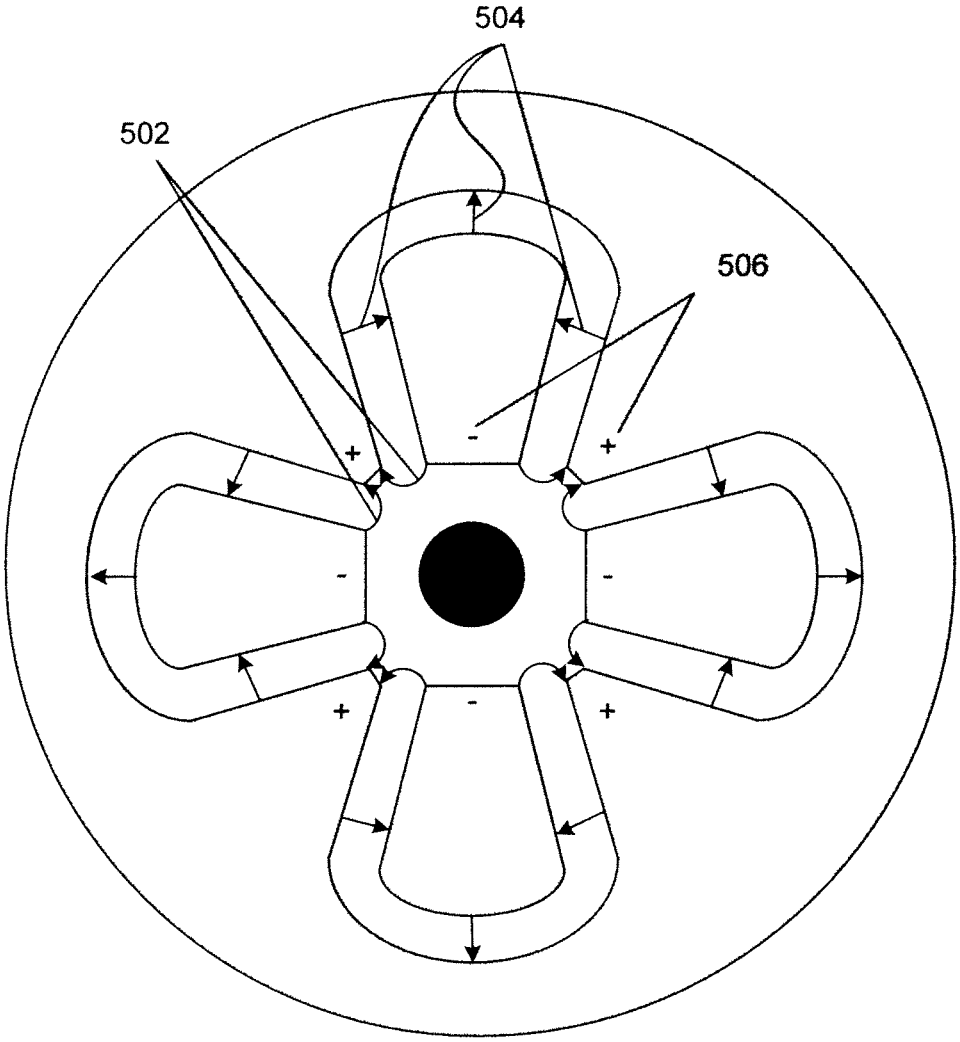
FIG. 5 depicts a slow-wave waveguide harmonic mode magnetron structure operating in the 4π mode.

FIG. 4 shows the local field maxima during one half cycle of the harmonic mode magnetron operating in the $2\pi$ mode. The arrow lines 402 represent circumferential electric field vectors during one half cycle maximum of the RF frequency. The field line 404 shows that half way through the waveguide, the RF signal has an inverse phase relationship with the two waveguide openings in the $2\pi$ mode. The RF circumferential field maximums 406 are also in anti-phase at the circumference, which allows the harmonic mode magnetron to sustain oscillations having phase change coefficients of $2\pi$ radians per section. Similarly, FIG. 5 shows the local field maximums during one half cycle of the harmonic mode magnetron operating in the $4\pi$ mode. The arrow lines 502 represent circumferential electric field vectors during one half cycle maximum of the RF frequency. The RF circumferential field maximums 506 are also in anti-phase at the circumference, which allows the harmonic mode magnetron to sustain oscillations having phase change coefficients of $4\pi$ radians per section. It is evident that the principle of using waveguides in the anode would sustain oscillations having phase change coefficients of $2\pi$*n radians per section (where n is a positive integer).

Using the waveguide in place of a traditional resonant cavity allows for a larger magnetron and magnetron anode operating at the same high frequency when compared with a magnetron typical of the prior art. The waveguide structure allows a harmonic mode magnetron operating in the $2\pi$ mode to have the same circumferential RF field components as a magnetron typical of the prior art when operating in the $\pi$ mode. In addition, the circumferential RF field components also remain the same for all $2\pi$*n modes where n is a positive integer. In other words, the harmonic mode magnetron is capable of supporting RF oscillation at frequency harmonics of the fundamental frequency. This could permit a harmonic mode magnetron to operate at frequencies that are double or four times those that a similarly sized magnetron of standard construction would achieve. Also, a harmonic mode magnetron operating at the same frequency as a magnetron of standard construction is capable of producing more output power.

Figure 6:
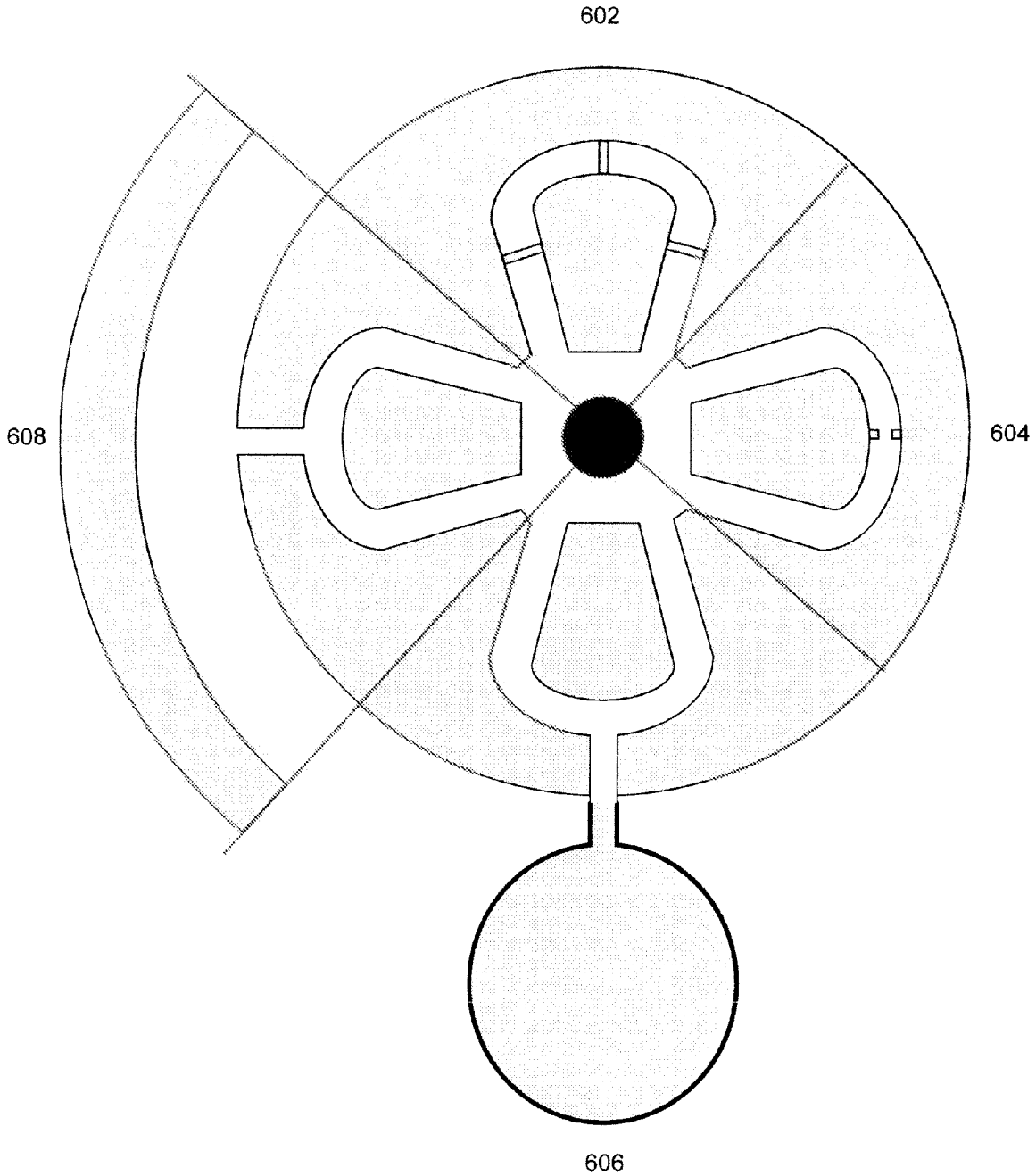
FIG. 6 depicts a variety of structures for providing mode selection.

Because the harmonic mode magnetron is capable of supporting operating modes at a number of different frequency harmonics of the frequency corresponding to the normal $\pi$ mode, it is anticipated that the slow-wave structure proposed will require techniques for mode isolation. FIG. 6 illustrates some of the proposed structures to achieve the goal of mode isolation. Each waveguide section is shown in conjunction with one of the proposed methods. The waveguides in the top and right positions, 602 and 604, illustrate the use of periodically placed irises providing mode selection. The three periodically placed irises in 602 would support a $4\pi$ mode of oscillation while the single iris shown in 604 would support a $2\pi$ mode of oscillation. The irises can be either transmitting or non-transmitting irises, which will be determined by the design parameters of the magnetron. In this form utilizing irises to provide mode selection, the invention acts as a "coupled cavity magnetron."

The waveguides in the bottom and left positions, 606 and 608, illustrate the use of a resonant high Q cavity in proximity to the magnetron anode to effectuate mode selection. In this type of topology, the preferred mode of operation is achieved by selecting or designing a resonant high Q cavity with a resonant frequency corresponding to the desired operating frequency of the magnetron. Element 606 illustrates the use of discrete resonant high Q cavities coupled with slow-wave waveguide structures within the anode. Element 608 illustrates the use of a coaxial high Q cavity coupled with the slow-wave waveguide structures within the anode. Although both of these designs are shown with a coupling slot, it is not strictly necessary that each waveguide within the structure is coupled to a high Q cavity to achieve the preferred operating mode. One skilled in the art will understand that any topology that supports a particular operating frequency consistent with a desired $2\pi$*n mode fall within the scope and spirit of this invention.

Figure 7:
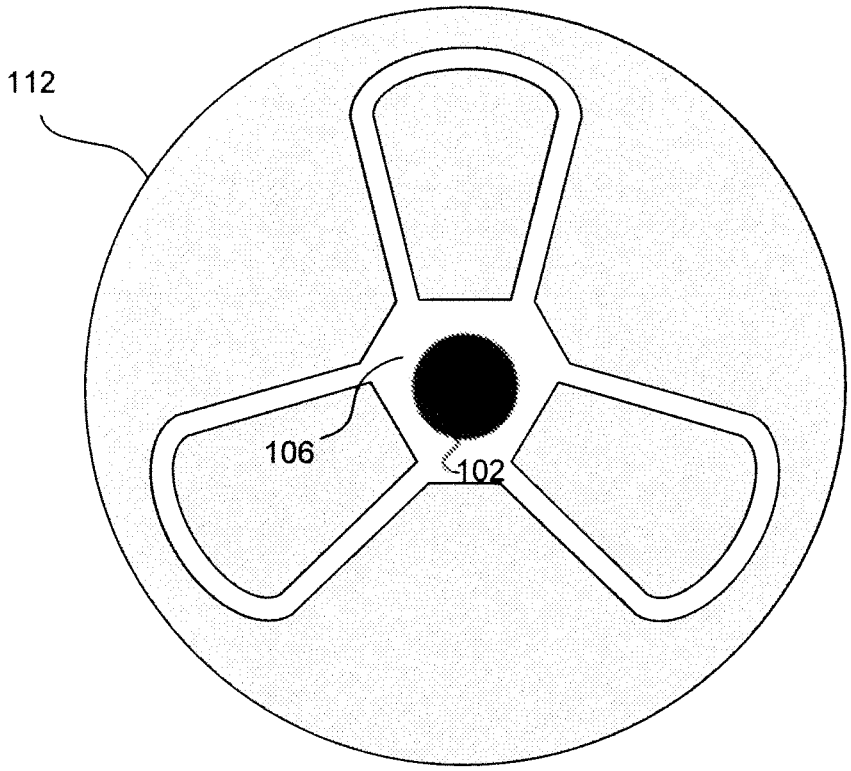
FIG. 7 depicts a slow-wave waveguide harmonic mode magnetron structure with an odd number of resonant waveguides.

FIG. 7 demonstrates a magnetron anode comprising an odd number of resonators. The distinction between this invention and prior magnetron art is that a conventional magnetron having an odd number of resonators cannot work. Since this invention is specifically designed to operate in $2\pi$*n mode, an odd number of resonators is expected to be an advantage in that the $\pi$ mode is effortlessly suppressed. The invention is solely defined by the following claims.

The invention claimed is:

1. A harmonic mode magnetron for converting DC electrical current to radio frequency (RF) power comprising:

an anode body formed from a conductive material and including a central cavity; and a cathode fixed within the central cavity of the anode body;

wherein the anode body further comprises at least two slow-wave waveguide structures formed within the anode body, each slow-wave waveguide structure comprising a channel having a rectangular cross section cutting through the anode body in a continuous path and having two openings into the central cavity such that the two openings and the channel define a central column of anode body material between them and wherein the central column forms one broadwall of the slow-wave waveguide structure and wherein another broadwall of the slow-wave waveguide structure is formed from the anode body.

2. The harmonic mode magnetron of claim 1, wherein each slow-wave waveguide structure further comprises one narrow wall formed from the anode body material and another narrow wall formed from a cap material joined to the anode body.

3. The harmonic mode magnetron of claim 1, wherein each slow-wave waveguide structure further comprises two narrow walls formed from the anode body material.

4. The harmonic mode magnetron of claim 1, wherein the anode body is formed from copper.

5. The harmonic mode magnetron of claim 1, further comprising mode-isolating structures for suppressing certain harmonic oscillation modes.

6. The harmonic mode magnetron of claim 5, wherein the mode-isolating structures comprise irises disposed within at least one of the slow-wave waveguide structures.

7. The harmonic mode magnetron of claim 6, wherein at least some of the irises disposed within at least one of the slow-wave waveguide structures are transmitting irises.

8. The harmonic mode magnetron of claim 6, wherein at least some of the irises disposed within at least one of the slow-wave waveguide structures are non-transmitting irises.

9. The harmonic mode magnetron of claim 5, wherein the mode-isolating structures comprise resonant high-Q cavities constructed with a resonant frequency corresponding to a desired operating frequency of the harmonic mode magnetron.

10. The harmonic mode magnetron of claim 9, wherein the mode-isolating structures comprise discrete high-Q cavities coupled to each slow-wave waveguide structure.

11. The harmonic mode magnetron of claim 9, wherein the mode-isolating structures comprise a coaxial cavity coupled to multiple slow-wave waveguide structures.

12. The harmonic mode magnetron of claim 1, wherein the anode body includes an odd number of slow-wave waveguide structures such that the $\pi$ resonant mode is suppressed.

* * * * *